US005238455A

United States Patent [19]

Cain, Jr. et al.

[11] Patent Number: 5,238,455

[45] Date of Patent: Aug. 24, 1993

[54] OMNI-DIRECTIONAL ROCKING APPARATUS

[75] Inventors: Ralph E. Cain, Jr.; Fred H. Yeatts, both of Sanger, Tex.

[73] Assignee: Sequoia Wood Designs, Inc., Sanger, Tex.

[21] Appl. No.: 806,013

[22] Filed: Dec. 9, 1991

[51] Int. Cl.[5] ..... E04H 31/00

[52] U.S. Cl. ..... 472/102; 472/95; 472/110; 472/106; 472/114; 472/135

[58] Field of Search ..... 472/95, 98, 99, 100, 472/102, 106, 110, 114, 130, 135

[56] References Cited

U.S. PATENT DOCUMENTS 2,417,615 3/1947 Scott ..... 472/114
2,541,483 2/1951 Rowden ..... 472/114 X
2,658,753 11/1953 Dawson ..... 472/130
2,743,104 4/1956 Dodson ..... 472/102 X

*Primary Examiner*—Carl D. Friedman
*Assistant Examiner*—Beth A. Aubrey
*Attorney, Agent, or Firm*—Ross, Howison, Clapp & Korn

[57] ABSTRACT

An omni-directional rocking apparatus includes a rocking base assembly and seating assembly. The rocking base assembly comprises at least two arched transverse members with distally disposed contoured stops adapted to limit the range of rocking motion in any direction. In one preferred embodiment, the rocking apparatus is constructed as a tip-resistant, omni-directional riding toy wherein the seating assembly comprises a simulated animal body, vehicle or other conveyance device.

6 Claims, 2 Drawing Sheets

OMNI-DIRECTIONAL ROCKING APPARATUS

TECHNICAL FIELD

This invention relates to a rocking apparatus, and more particularly, to a tip-resistant, omni-directional riding toy with a simulated animal body seat structure.

BACKGROUND OF THE INVENTION

The use of approximately parallel arched beams as base members for apparatuses such as rocking chairs and rocking horses is well known. Such rocking apparatuses allow the user to rock only with a forward and backward motion. Notwithstanding rocking apparatuses that have previously been disclosed, there remains a need for a stable rocking apparatus which can be rocked in all directions in the plane of an underlying support surface without the danger of easily tipping over. Such features are particularly desirable in the design and construction of riding toys for children.

SUMMARY OF THE INVENTION

According to the present invention, a rocking apparatus is provided that is capable of being omni-directionally rocked without easily tipping over. The subject rocking apparatus comprises a base assembly and a seating assembly connected as a fixed unitary structure. The base assembly further comprises at least two transverse arched beams with two contoured stops distally connected to each beam. The rocking apparatus further comprises at least one graspable member adapted for the user to hold onto during use and to assist in achieving the rocking motion.

According to one preferred embodiment of the invention, two contoured stops of the base assembly are placed along each beam equidistant from the ground contacting fulcrum of the apparatus when it is in a stationary position. When constructed in this manner, the rocking apparatus remains tip-resistent during omni-directional rocking. During use, rough, multidirectional rocking shifts the ground contacting region from the centrally located fulcrum toward the distally placed contoured stops, where the stops limit the range of rocking motion, reinforce stability, and keep the apparatus upright.

According to another preferred embodiment of the invention, the rocking apparatus is constructed as a riding toy with a fixed seating assembly. The seating assembly preferably comprises a simulated animal body attached to the base assembly as a single unit.

According to another embodiment of the invention, the seating assembly of the riding toy is constructed as a simulated vehicle or other conveyance device.

According to another embodiment of the invention, the base assembly of the riding toy includes decorations characteristic of the seating assembly's simulated animal body, vehicle or other conveyance device.

According to another embodiment of the invention, the seating assembly is constructed as a simulated body of a bull with a looped hand strap across the front of the seat and two hand grips above the simulated ears for gripping during omni-directional rocking.

BRIEF DESCRIPTION OF THE DRAWINGS

The apparatus of the invention is further described and explained in relation to the following figures of the drawings wherein.

DETAILED DESCRIPTION OF A PREFERRED EMBODIMENT

Figure 3:
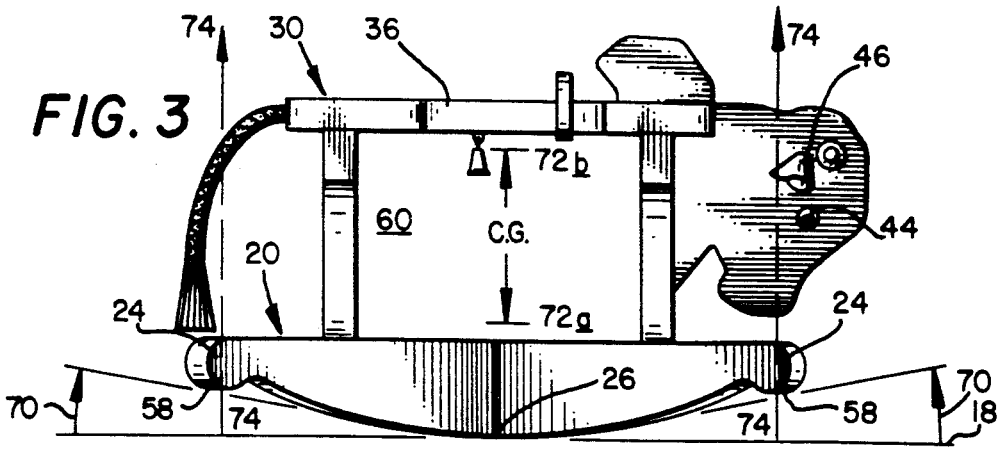
FIG. 3 depicts a side elevation view of the apparatus shown in FIG. 1.
Figure 5:
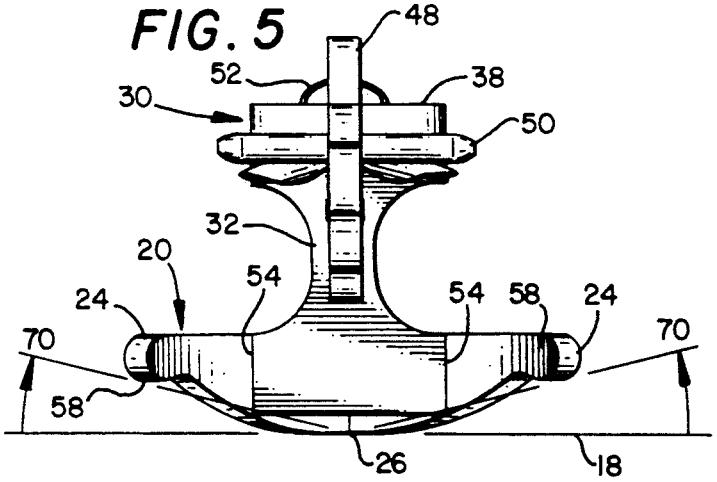
FIG. 5 depicts a front elevation view of the apparatus shown in FIG. 1.
Figure 6:
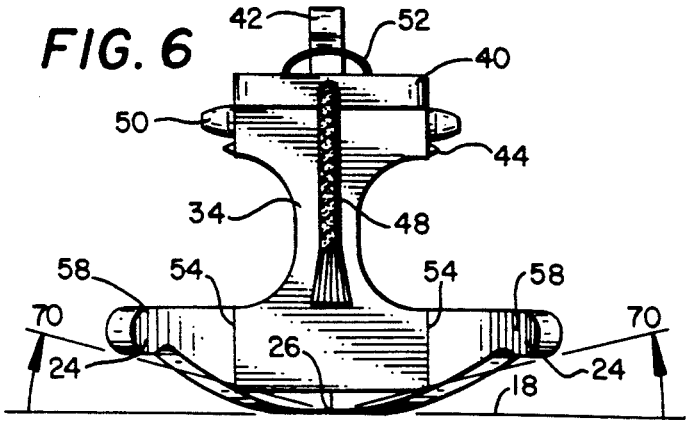
FIG. 6 depicts a rear elevation view of the apparatus shown in FIG. 1.

Referring to FIGS. 1–4, the rocking apparatus is shown as riding toy 10 which preferably comprises a base assembly 20 and a seating assembly 30. Base assembly 20 further comprises two transverse arched rocking beams 22, four contoured stops 24, and fulcrum 26. Referring to FIGS. 3, 5 and 6, fulcrum 26 is in contact with the underlying supporting surface 18 when the riding toy is in a stationary position.

The base assembly is preferably constructed from planks of wooden material cut to suitable size and then connected by conventional methods such as by bolts, dowels, nails or the like. Although wooden material is preferred for use in making the base assembly 20, it will be understood and appreciated that various other materials can be similarly utilized, depending upon the intended strength and appearance of the apparatus. Thus, for example, plastic, fiberglass, or metal might be a preferred material for use in some applications. Where base assembly 20 is constructed from plastic or fiberglass, the transverse beams 22 and contoured stops 24 can be molded as a unit if desired.

Although construction of the base assembly as shown in FIGS. 1–4 is preferred for use in making the apparatus of the invention, additional beams and stops radially placed can also be employed within the scope of the invention subject to certain limitations as discussed in more detail below.

Referring to FIGS. 3, 5, and 6, base assembly 20 is preferably supporting and fixed to seating assembly 30 at connection points 54, forming an interior space 60. As shown in FIGS. 1, 3, 5 and 6, seating assembly 30 preferably comprises front support 32, rear support 34, seat 36, hand grips 50 and strap 52. Seating assembly is additionally provided with decorative parts such as imitation animal head 42, with eyes 44 and ears 46, and imitation animal tail 48.

As shown in FIGS. 1, 3, 5 and 6, seat 34 with looped hand strap 52 is fastened to both front support 32 and rear support 34. Supports 32 and 34 are then suitably mounted to transverse beams 22. Imitation animal head 42 containing hand grips 50 is fastened to front support 32 and the top front 38 of seat 34. Imitation animal tail 48 is suitably attached to rear 40 of seat 34.

Seating assembly 30 is preferably made of wood material, it being understood and appreciated that various other materials can be similarly utilized as discussed above regarding the base assembly 20. Decorative parts, such as eyes 44 and ears 46, can be constructed out of any suitable material the designer finds aesthetically pleasing.

Although in its preferred embodiment, the riding toy 10 as shown in FIGS. 1, 3, 5 and 6, is constructed in the form of livestock such as a horse or bull, other shapes and configurations can also be employed within the scope of the invention subject to certain limitations on the range of rocking discussed in more detail below.

Figure 1:
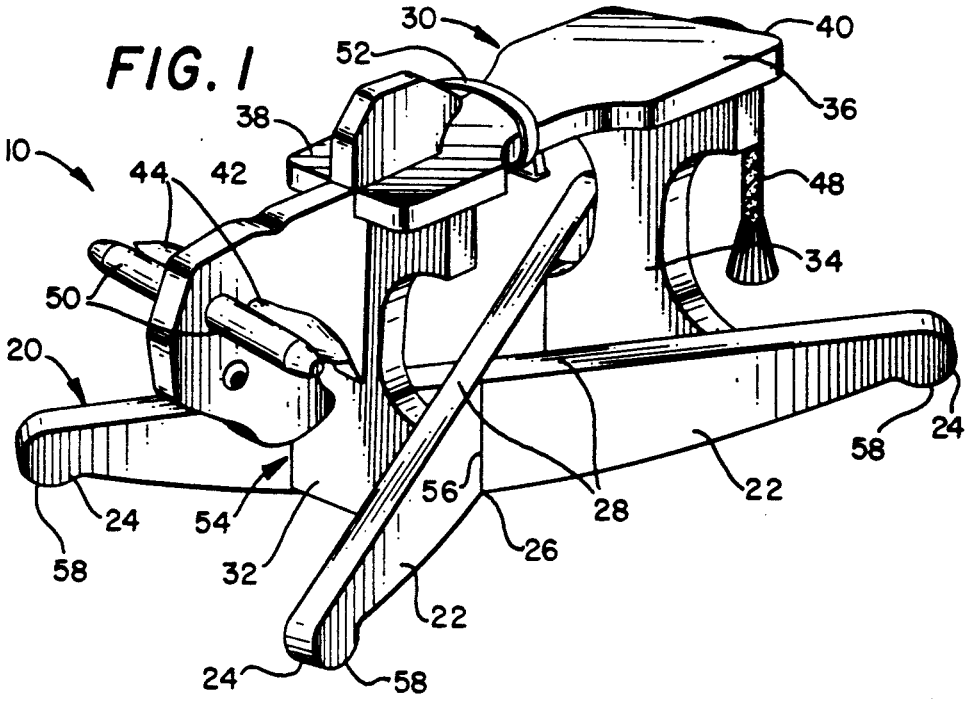
FIG. 1 is a perspective view of one preferred embodiment of the present invention.
Figure 2:
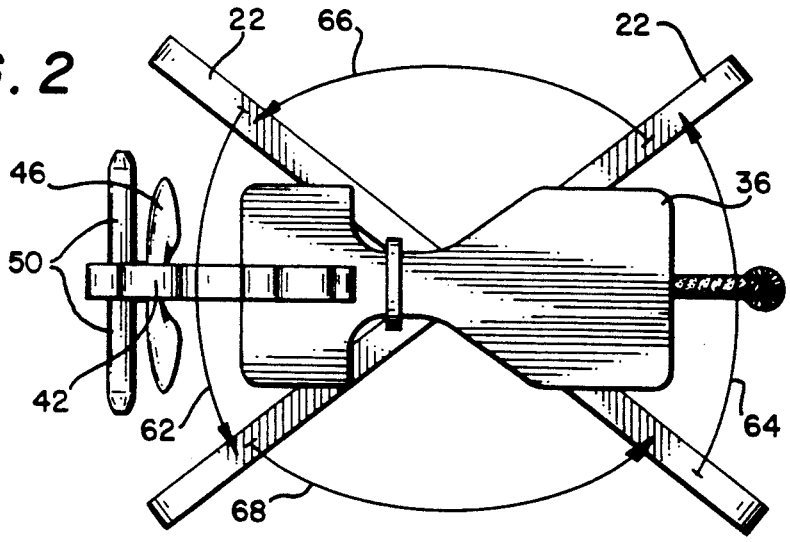
FIG. 2 depicts a top plan view of the apparatus shown in FIG. 1.

Referring to FIG. 1, operation of the apparatus requires the rider to straddle seat 34 facing forward with at least one hand on either loop 48 or hand grips 46. Depending upon user preference and size, the user's feet hang freely or rest anywhere along beam tops 28 of beams 22.

Referring to FIG. 3, the rider shifts the center of gravity 72 with varied body movements and rocks the apparatus outwardly in any direction from the initial ground contacting position of fulcrum 26.

Although the specific configuration of riding toy 10 can vary widely within the scope of the invention, certain limitations are preferably observed in designing the apparatus in order to maximize the beneficial functions of the invention. Thus, for example, with reference to FIG. 3, it is preferred that the base assembly and seating assembly be designed in such a manner that the center of gravity 72*a* of the unmounted riding toy 10 is located in the lower half of interior space 60. When in use, depending upon the height and weight of the rider, the center of gravity 72*b* of the mounted riding toy 10 preferably will not shift beyond the upper limit of interior space 60.

Figure 4:
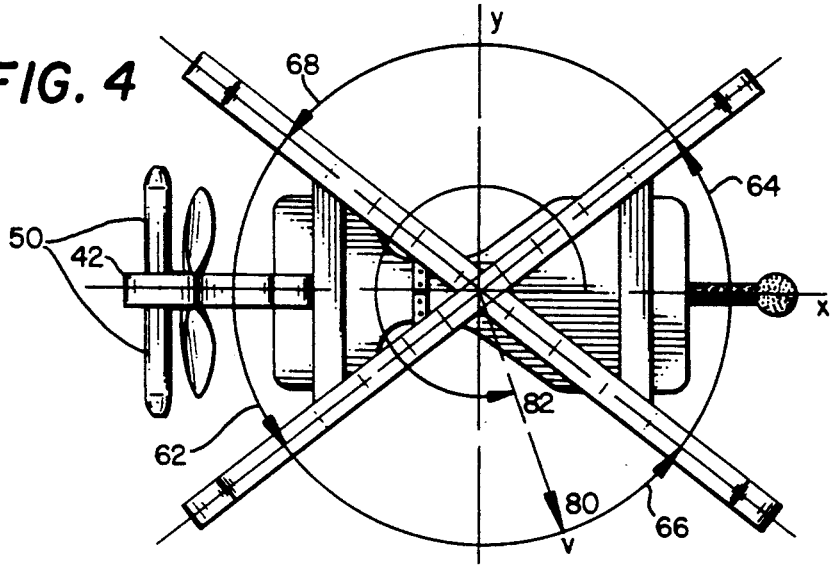
FIG. 4 depicts a bottom plan view of the apparatus of FIG. 1.

Referring to FIG. 4, the radial direction of motion is identified as vector v 80 in the xy-plane of the underlying supporting surface 18. Proper placement of the transverse beams 22 allows angle 82 to lie anywhere in the range from 0 to 360 degrees with the curvilinear motion of the apparatus being defined by v 80. Vector v 80 lies in any direction in the xy-plane. For example, when angle 82 is equal to either 0 or 180 degrees, radial vector v lies along the x-axis and the rocking motion is forward and backward like a standard rocking device. If angle 82 is either 90 or 270 degrees, the apparatus can be safely rocked in the lateral directions, with v lying along the y-axis. Additionally, as shown in FIG. 4, the rider can rock along any length of the four arcs identified by angles 62, 64, 66, and 68 without passing through fulcrum 26. The rocking direction, v, can also be randomly changed by user's preference through rocking in a combination of directions through all four quadrants of the xy-plane, including rotation around the arcs of angles 62, 64, 66 and 68.

The magnitude of v also varies with the rocking motion. When the apparatus is at rest with fulcrum 26 as the ground contacting point, the magnitude of v is zero. The magnitude of v increases as the radial range of rocking motion increases. Its maximum magnitude is limited by the distance between fulcrum 26 and stop 24. When the rocking motion becomes large in any direction v, or along the arc of angles 62, 64, 66, and 68, the ground contacting portion of the beams 22 shifts between the lower curvature of each of the beams and contoured stops 24, thereby limiting the range of rocking motion. Impact of the stops with the ground desirably creates a return force that facilitates rocking the apparatus between the curved beams and stops and to its equilibrium position over the fulcrum, improving stability of the apparatus during use.

Referring to FIGS. 1 and 4, according to a preferred embodiment of the invention adapted to maximize the benefits of tip-resistant, omni-directional rocking for a child's riding toy, the transverse rocking beams 22 are approximately 34" in length, four and three-eighths inches high along line 56 between the beam top 28 and fulcrum 26, and two and one-half inches high at point 58 between the beam top 28 and the bottom of the contoured stop 24. At the point of intersection, fulcrum 26, the beams 22 preferably define 70 degree angles at front angle 62 and rear angle 64 and 110 degree angles at lateral angles 66 and 68.

Referring to FIG. 3, with fulcrum 26 contacting underlying support surface 18, the rise 70 to the stop 24 is at approximately a 10 degree angle with the underlying supporting surface 18. While rocking with this configuration, the variable position of the center of gravity is prevented from rising to a placement perpendicular to the ground contacting position of stops 24. Instead, contoured stops 24 limit the range of rocking motion, thereby limiting the shift in the center of gravity to a point in the direction of rocking that is short of the plane 74 normal to the rocking direction through contact point 58 of contoured stop 24. This improves stability and keeps the riding toy upright.

Although the apparatus of the invention has been described herein in relation to its preferred embodiments, other alterations and modifications of the invention will become apparent to those of ordinary skill in the art upon reading the present disclosure, and it is intended that the scope of the invention be limited only by the broadest interpretation of the claims to which the inventor is legally entitled.

I claim:

1. A rocking apparatus comprising a rocking base assembly and a seating assembly connected to said base assembly; said base assembly comprising two diagonally disposed rocking members crossed at a median point of the rocking apparatus with two distally disposed contoured stops on each rocking member which limit rocking to a predetermined distance in any direction.

2. The rocking apparatus of claim 1 wherein the seating assembly comprises a simulated animal body.

3. The rocking apparatus of claim 2 wherein the seating assembly comprises a simulated bull.

4. The rocking apparatus of claim 1 wherein the seating assembly comprises a simulated conveyance device.

5. The rocking apparatus of claim 1 wherein the seating assembly includes graspable means for holding onto the seating assembly while rocking.

6. The rocking apparatus of claim 1 wherein the seating assembly comprises at least two supporting members connected to said base assembly.

* * * * *